US006889656B1

(12) United States Patent
Rembold et al.

(10) Patent No.: US 6,889,656 B1
(45) Date of Patent: May 10, 2005

(54) FUEL SUPPLY SYSTEM OF AN INTERNAL COMBUSTION ENGINE

(75) Inventors: Helmut Rembold, Stuttgart (DE); Kurt Frank, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/298,926

(22) Filed: Apr. 26, 1999

(30) Foreign Application Priority Data

Apr. 24, 1998 (DE) ..... 198 18 421

(51) Int. Cl.[7] ..... F02M 37/04
(52) U.S. Cl. ..... 123/446; 123/497
(58) Field of Search ..... 123/447, 456, 123/446, 179.17, 381

(56) References Cited

U.S. PATENT DOCUMENTS

| | | | | | |
|---|---|---|---|---|---|
| 4,756,291 | A | * | 7/1988 | Cummins et al. | 123/497 |
| 4,800,859 | A | | 1/1989 | Sagisaka | |
| 4,884,545 | A | * | 12/1989 | Mathis | 123/447 |
| 4,951,631 | A | * | 8/1990 | Eckert | 123/446 |
| 5,313,923 | A | | 5/1994 | Takeuchi | |
| 5,542,395 | A | * | 8/1996 | Tuckey | 123/381 |
| 5,598,817 | A | * | 2/1997 | Igarashi | 123/179.17 |
| 5,622,152 | A | * | 4/1997 | Ishida | 123/446 |
| 5,651,347 | A | * | 7/1997 | Oi | 123/179.17 |
| 5,740,783 | A | * | 4/1998 | Learman et al. | 123/497 |
| 5,758,622 | A | * | 6/1998 | Rembold | 123/179.17 |
| 5,794,586 | A | * | 8/1998 | Oda | 123/179.17 |
| 5,839,413 | A | * | 11/1998 | Krause | 123/179.17 |
| 5,848,583 | A | * | 12/1998 | Smith | 123/381 |
| 6,021,763 | A | * | 2/2000 | Yoshihara | 123/179.17 |
| 6,047,682 | A | * | 4/2000 | Fujino | 123/381 |
| 6,223,731 | B1 | * | 5/2001 | Yoshiume et al. | 123/497 |

FOREIGN PATENT DOCUMENTS

| | | |
|---|---|---|
| DE | 37 10 127 | 10/1987 |
| DE | 37 05 848 | 9/1988 |
| DE | 689 25 733 | 12/1989 |
| DE | 40 16 055 | 11/1991 |
| DE | 40 19 083 | 12/1991 |
| DE | 44 01 083 A | 7/1995 |
| DE | 1 95 398 83 A1 | 11/1996 |
| DE | 1 95 398 85 A1 | 11/1996 |
| DE | 196 22 071 | 1/1997 |
| DE | 196 18 932 A | 11/1997 |
| DE | 197 27 413 | 1/1999 |
| EP | 0 651 152 | 5/1995 |
| FR | 2 742 809 A | 6/1997 |
| WO | WO 95 13474 A | 5/1995 |

* cited by examiner

*Primary Examiner*—Carl S. Miller
(74) *Attorney, Agent, or Firm*—Ronald E. Greigg

(57) ABSTRACT

In fuel supply systems with two fuel pumps connected in series and fuel valves that inject directly into the combustion chamber, there have been occasional problems. The proposal is made that in order to eliminate these problems, the first fuel pump operates with increased delivery capacity, particularly during the startup process and in the event of high fuel temperature. The fuel supply system is provided for an internal combustion engine of a vehicle.

25 Claims, 2 Drawing Sheets

FUEL SUPPLY SYSTEM OF AN INTERNAL COMBUSTION ENGINE

BACKGROUND OF THE INVENTION

The invention is based on a fuel supply system for delivering fuel for an internal combustion engine set forth hereinafter.

Up till now, there have been fuel supply systems in which a first fuel pump delivers fuel from a fuel tank to a second fuel pump by way of a fuel connection. For its part, the second fuel pump delivers the fuel via a pressure line to at least one fuel valve. Normally, the number of fuel valves is the same as the number of cylinders of the engine. The fuel supply system can be designed so that the fuel valve injects the fuel directly into a combustion chamber of the engine. During operation of this fuel supply system, a high pressure is required in the pressure line leading to the fuel valve. For safety reasons, and due to leaks of the fuel valve into the combustion chamber which can never be completely prevented, it is useful after the engine is shut off to either completely or at least largely reduce the pressure in the fuel connection and in the pressure line of the fuel supply system.

When the engine is shut off, if the pressure in the fuel supply system is largely or completely reduced, then a vapor bubble can form in the fuel connection between the first fuel pump and the second fuel pump or in the pressure line between the second fuel pump and the fuel valve. The size of the vapor bubble or the number and size of the individual bubbles of the vapor bubble depends among other things, particularly on the temperature prevailing in the engine compartment after the engine has been shut off. The vapor bubble must be bled out from the lines or be compressed before a renewed starting of the engine. Since the delivery quantity of the second fuel pump is relatively slight during the starting of the engine and it would therefore take a very long time until the vapor bubble in the pressure line is compressed, which would result in long startup times in order to start the engine, the published, non-examined German patent disclosure DE 195 39 885 A1 proposes that the first fuel pump delivers the fuel directly into the pressure line leading to the fuel valve, bypassing the second fuel pump. However, since the first fuel pump is designed for the normal operating state of the engine, a determination had to be made that the startup process proposed in DE 195 39 885 A1 does in fact lead to a considerable shortening of the startup time that is not, however, short enough under all circumstances that all conceivable desires are fulfilled as a result.

OBJECT AND SUMMARY OF THE INVENTION

The fuel supply system according to the invention has an advantage over the prior art that the quantity of fuel delivered by the first fuel pump can be adapted as needed to the currently prevailing operating conditions of the engine.

In particular, it is advantageously possible that during the startup of the engine, the delivery capacity of the first fuel pump is increased, by means of which the startup time of the engine can be significantly reduced.

Due to the increased delivery capacity during the startup of the engine, a possible vapor bubble inside the system can be very rapidly eliminated, which leads to a considerable shortening of the startup process.

Another advantage is that the fuel quantity delivered by the first fuel pump can also be adjusted as needed, after the startup of the engine during the normal operating state.

The changeable delivery capacity can advantageously be adapted to the respectively prevailing operating conditions. As a result, difficulties that occur otherwise, for example at higher temperatures, can be easily prevented.

Advantageous improvements and updates of the fuel supply system are possible by means of the measures taken hereinafter.

If the delivery capacity of the first fuel pump is changed in such a way that it is driven at a different speed, then the advantage is achieved that even when using a fuel pump that is inexpensive to produce and test, the delivery capacity of the first fuel pump can be changed in a simple manner.

If the delivery capacity of the first fuel pump is increased during the startup of the engine, then as a result, the startup time of the engine is advantageously shortened considerably.

If the first fuel pump is operated so that it functions with a greater delivery capacity at a higher temperature, then as a result, the formation of vapor bubbles and the resultant irregular delivery of the second fuel pump can be prevented in a simple manner.

If the first fuel pump functions with a greater delivery capacity at a higher temperature, then the first fuel pump can be designed so that at a normal temperature and at low temperature of the fuel, it functions with a lower delivery capacity, which extends the service life of the first fuel pump and reduces the average drive output required to drive the first fuel pump.

If the first fuel pump is operated with overspeed for the startup of the engine, then the advantage is obtained that the fuel pump does not have to be embodied as larger and more expensive, even if it produces an increased delivery capacity during startup. Since the startup of the engine only lasts a short time, then even if the first fuel pump is operated with an overspeed during the startup, no unacceptable shortening of the service life of the first fuel pump need be feared. Despite a momentarily increased delivery capacity, there is the advantage of a small fuel pump and a small drive motor.

By changing the drive speed of the electric motor driving the first fuel pump, the delivery capacity of the first fuel pump can be advantageously realized in a very simple manner and without high cost.

By switching on the electrical series resistor or bypassing it, the speed and thereby the delivery capacity of the first fuel pump can be very easily changed without high structural cost.

If two pressure control valves are provided for monitoring the delivery pressure prevailing in the fuel connection between the first fuel pump and the second fuel pump, wherein one of the two pressure control valves monitors the pressure, for example during the startup of the engine, and the other pressure control valve monitors the delivery pressure during the normal operation of the engine, then the advantage is also obtained that the pressure in the fuel connection reaches the designated level as needed with narrow tolerance limits. In particular during the startup of the engine, a precisely defined level of delivery pressure is assured, even if the first fuel pump is functioning with a sharply increased delivery capacity.

The need for fuel to be delivered can advantageously be determined very easily from the injection time of the at least one fuel valve or from the speed of the engine, particularly when both the injection time and the engine speed have to be taken into account. In order to control the engine for various reasons, the injection time and the engine speed are usually detected by the motor control so that these values are available for controlling the delivery capacity of the first fuel pump at no additional cost. In particular, despite the possibility offered for precise control of the first fuel pump as needed, no pressure sensor is provided in the fuel connection, which would represent an additional, not insignificant cost.

If a valve device that influences the delivery pressure is provided, and if the valve device is embodied so that the valve device has a through flow resistance that is dependent on the through flow of the fuel, then an ability to electrically control the valve device can advantageously be dispensed with, which considerably reduces manufacturing costs.

The possibility for electrically controlling the valve device offers the additional advantage of electrically controlling the delivery pressure for example by way of a control device in conjunction with a program that is input into the control device.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
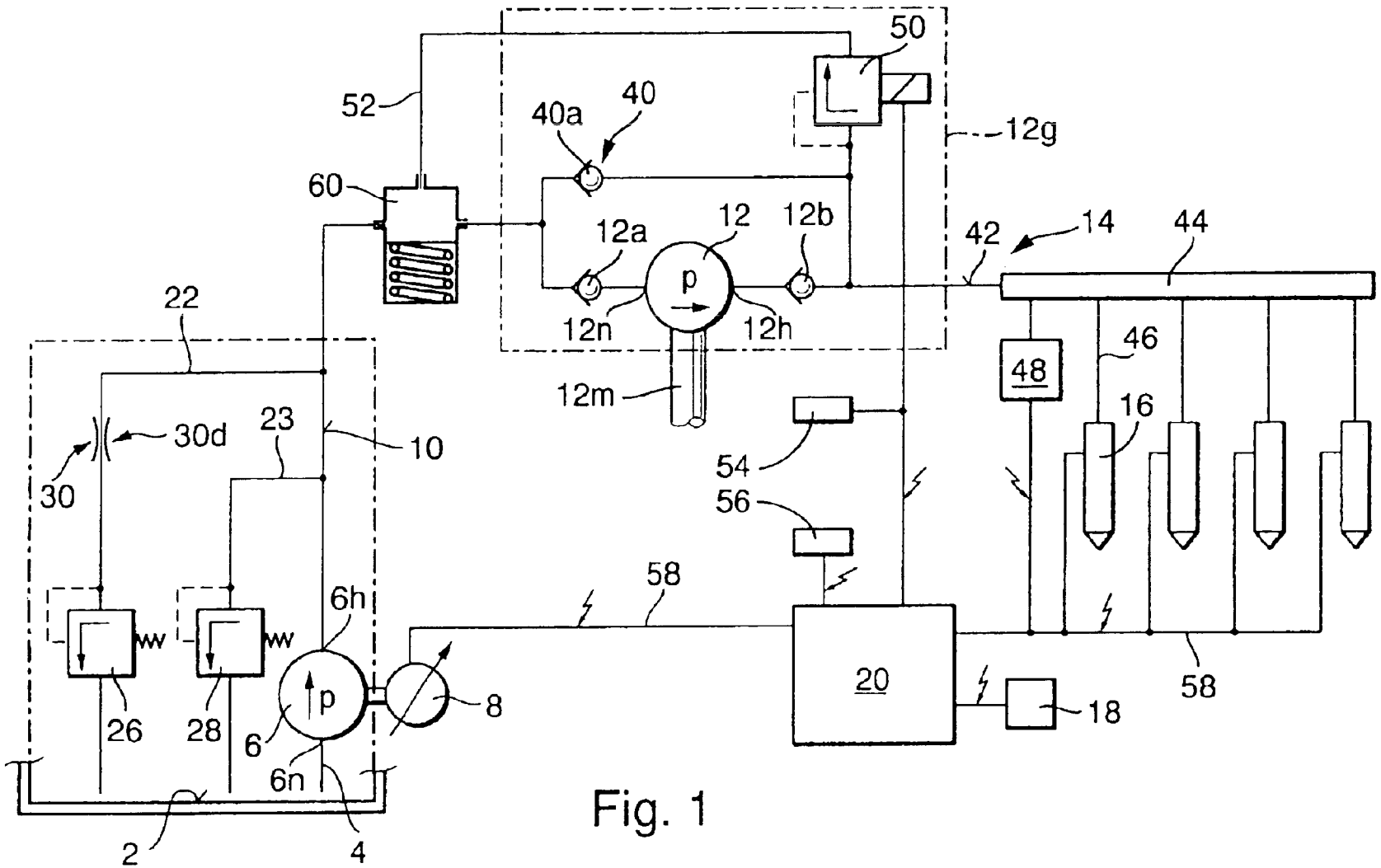
FIGS. 1 and 2 respectively show a selected, particularly preferably embodied exemplary schematic embodiment of the fuel supply system.

The fuel supply system according to the invention, for metering fuel for an internal combustion engine, can be used in different types of engines. The engine, for example, is a gasoline engine with an external or internal mixture formation and externally supplied ignition, wherein the engine can be provided with a reciprocating piston (reciprocating piston engine) or with a rotatably supported piston (rotary piston engine). The engine can, for example, also be a hybrid engine. In this engine with stratified charge, the fuel/air mixture in the combustion chamber is enriched in the vicinity of a spark plug until a reliable ignition is assured, but the combustion occurs in the center where there is a very lean mixture.

The gas exchange in the combustion chamber can, for example, take place in accordance with the four-stroke process or in accordance with the two-stroke process. Gas exchange valves (inlet valves and outlet valves) can be provided in a known manner for controlling the gas exchange in the combustion chamber of the engine. The engine can be embodied so that at least one fuel valve injects the fuel directly into the combustion chamber of the engine. The control of the output of the engine is carried out as a function of the operating mode by controlling the quantity of fuel supplied to the combustion chamber. However, there is also an operating mode in which the air supplied to the combustion chamber for the combustion of the fuel is controlled with a throttle valve. The output to be delivered by the engine can also be controlled by the position of the throttle valve.

The engine has, for example, one cylinder with a piston or it can be provided with a number of cylinders and a corresponding number of pistons. Preferably, each cylinder is provided with a respective fuel valve.

In order to keep the size of the description from being unnecessarily extensive, the following description of the exemplary embodiments is limited to a reciprocating piston engine with four cylinders as the internal combustion engine, wherein the four fuel valves inject the fuel, usually gasoline, directly into the combustion chamber of the engine. Depending on the operating mode, the output of the engine can be controlled by controlling the injected fuel quantity or by a throttling of the incoming air. When idling and when in the lower partial load range, a stratified charging takes place, with fuel enrichment in the region of the spark plug. The mixture is very lean outside this region around the spark plug. When at full load or in the upper partial load range, a homogeneous distribution between the fuel and air is sought in the whole combustion chamber.

In the description below, for the sake of simplicity, a distinction is drawn between an operating state of the engine and a start process. The term startup process is understood below to mean the process from the beginning of the startup of the engine until the achievement of the operating state. The term operating state is understood below to mean the operation of the engine under operating conditions after the startup process, wherein the operating conditions can vary widely. In the operating state, a distinction is drawn below between an operating state in low, average, or moderate temperatures and an operating state at higher temperatures. The operating conditions vary widely depending on whether the engine has just now been started on and which temperatures prevail during and after the startup.

FIG. 1 shows a fuel tank 2, a suction line 4, a first fuel pump 6, an electric motor 8, a fuel connection 10, a second fuel pump 12, a pressure line 14, four fuel valves 16, an energy supply unit 18, and an electric or electronic control device 20. Among specialists, the fuel valves 16 are frequently referred to as injection valves or injectors.

The first fuel pump 6 has a pressure side 6*h* and a suction side 6*n*. The second fuel pump 12 has a high pressure side 12*h* and a low pressure side 12*n*. The fuel connection line 10 leads from the pressure side 6*h* of the first fuel pump 6 to the low pressure side 12*n* of the second fuel pump 12. A bypass fuel line 22 branches from the fuel connection line 10. Fuel from the fuel connection line 10 can be conveyed via the bypass fuel line 22 directly back into the fuel tank 2. Another bypass fuel line 23 branches from the fuel connection line 10. Fuel from the fuel connection line 10 can also be conveyed via the second fuel line 23 directly back into the fuel tank 2. The two bypass fuel lines 22, 23 function in a hydraulically parallel manner, but can also extend, at least for a section in a common conduit.

A pressure regulating valve or pressure control valve 26 and a valve device 30 are provided in the bypass fuel line 22. The pressure control valve 26 and the valve device 30 are operatively connected hydraulically in series. That is, the pressure control valve 26 and the valve device 30 are disposed in series in terms of their connection. Viewed in terms of the flow direction, the valve device 30 can be provided upstream or downstream of the pressure control valve 26. The pressure control valve 26 and the valve device 30 can also be embodied in the form of a single valve element. The pressure control valve 26 functions like a pressure limiting valve or a differential pressure valve; it assures that a largely constant pressure prevails between its inlet and outlet.

In the exemplary embodiment shown in FIG. 1, the valve device 30 is embodied in the form of a fixed throttle valve 30*d*. The throttle valve 30*d* of the valve device 30 is preferably embodied so that the through flow resistance of the throttle valve 30*d* increases quadratically as a function of the magnitude of the fuel flow passing through. The valve device 30 is used to increase the delivery pressure as needed in the fuel connection 10.

Another pressure regulating valve or pressure control valve 28 is provided in the other fuel line 23. The other pressure control valve 28 functions like a pressure limiting valve or a differential pressure valve and is closed when the pressure at its inlet lies below a particular value. The pressure control valve 28 is opened when the inlet side pressure exceeds a particular set value that is maintained by the pressure control valve 28. The other pressure control valve 28 can assure that the delivery pressure in the fuel connection 10 does not exceed a particular maximal value.

The pressure regulated by the other pressure control valve 28 is significantly higher than the pressure maintained by the pressure control valve 26. The pressure control valve 26 regulates the pressure on its inlet side, for example to 3 bar, which corresponds to 300 kPa. The other pressure control valve 28 is set, for example, to a pressure of 9 bar, which corresponds to 900 kPa.

The first fuel pump 6 is driven by the electric motor 8. The first fuel pump 6, the electric motor 8, the pressure control valve 26, the other pressure control valve 28, and the valve device 30 are disposed in the vicinity of the fuel tank 2. These parts are preferably disposed externally on the fuel tank 2 or are disposed inside the fuel tank 2, which is symbolically depicted by means of a dot-and-dash line.

By way of a mechanical transmission means 12*m*, the second fuel pump 12 is mechanically coupled to a drive shaft, not shown, of the internal combustion engine. Since the second fuel pump 12 is coupled to the drive shaft of the engine in a mechanically rigid manner, the second fuel pump 12 functions purely in proportion to the speed of the drive shaft of the engine. The speed of the drive shaft varies widely depending on the current operating conditions of the machine. For example, the drive shaft is a crankshaft of the engine.

An inlet-side check valve 12*a* is disposed in the fuel connection 10 on the low pressure side 12*n* of the second fuel pump 12. An outlet-side check valve 12*b* is provided in the pressure line 14 on the high pressure side 12*h* of the second fuel pump 12. Depending on the embodiment type of the second fuel pump 12, the check valves 12*a*, 12*b* can be dispensed with, if need be.

Functionally parallel to the second fuel pump 12, an opening device 40 leads from the fuel connection 10 into the pressure line 14. The opening device 40 includes a check valve 40*a*. The check valve 40*a* is disposed so that the first fuel pump 6 can supply the fuel into the pressure line 14 without being significantly hindered by the second fuel pump 12. The check valve 40*a* in the opening device 40 prevents the fuel supplied by the second fuel pump 12 from flowing back into the fuel connection 10 from the pressure line 14. Via the opening device 40, the first fuel pump 6 can feed directly into the pressure line 14 leading to the fuel valves 16, bypassing the second fuel pump 12.

The second fuel pump 12 is disposed inside a pump housing 12*g*, which is symbolically depicted with dot-and-dash lines. The check valves 12*a*, 12*b* and the opening device 40 can also be disposed inside the pump housing 12*g*.

Simply stated, the pressure line 14 leading from the second fuel pump 12 to the fuel valves 16 can be divided into a line section 42, a storage chamber 44, and distribution lines 46. The fuel valves 16 are each connected to the storage chamber 44 by a distribution line 46. A pressure sensor 48 is connected to the storage chamber 44 and senses the respective pressure of the fuel in the pressure line 14. In accordance with this pressure, the pressure sensor 48 sends an electrical signal to the control device 20.

A pressure valve 50 that can be electrically controlled by the control device 20 is connected to the pressure line 14. Depending on the control of the pressure valve 50, fuel is conveyed from the pressure line 14, via a return line 52, and into the fuel connection 10. A damping reservoir 60 is provided in the fuel connection 10.

The fuel supply system furthermore includes a sensor 54 or a number of sensors 54 and an accelerator pedal sensor 56. The sensors 54, 56 sense the operating conditions under which the engine is working. The operating conditions for the engine can be composed of a number of individual operating conditions. The individual operating conditions are, for example: temperature of the fuel in the fuel connection 10, temperature of the fuel in the pressure line 14, air temperature, cooling water temperature, oil temperature, speed of the engine or the drive shaft speed of the engine, composition of the exhaust gas of the engine, injection time of the fuel valves 16, etc. The accelerator pedal sensor 56 is disposed in the vicinity of the accelerator pedal and detects the position of the accelerator pedal as another individual operating condition and with it, detects the speed desired by the driver.

The electric motor 8, the fuel valves 16, the pressure sensor 48, the pressure valve 50, and the sensors 54, 56 are connected via electrical lines 58 to the energy supply unit 18 and the control device 20. The electrical line 58 between the fuel valves 16 and the control device 20 is embodied so that the control device 20 can trigger each of the fuel valves 16 separately. For the purpose of better differentiation from the other non-electrical lines, the electrical lines 58 are marked with a lightning symbol.

For example, the first fuel pump 6 is a rugged, easy-to-produce displacement pump which, driven by the electric motor 8, depending on the type, delivers a definite, constant quantity of fuel per revolution. The pressure of the fuel in the fuel connection 10: on the pressure side 6*h* of the first fuel pump 6 is referred to below as the delivery pressure.

The delivery capacity of the first fuel pump 6 can be changed. The change in the delivery capacity is preferably executed by virtue of the fact that the first fuel pump 6 is operated with a different speed. This saves the high cost for a pump with a changeable specific delivery volume. Since the first fuel pump 6 is driven by the electric motor 8, the speed of the first fuel pump 6 can very easily be changed by changing the drive speed of the electric motor 8. The change in the drive speed of the electric motor 8 is preferably executed by the control device 20.

The second fuel pump 12 delivers the fuel from the fuel connection 10 into the pressure line 14. The delivery quantity of the second fuel pump 12 depends on the speed of the drive shaft of the engine and consequently fluctuates considerably.

Depending on the signal of the pressure sensor 48 and depending on the operating condition of the engine, the control device 20 controls the pressure valve 50. During the normal operating state, the pressure in the pressure line 14 can be approximately 100 bar, for example, which corresponds to 10 MPa.

When the engine is shut off, normally the fuel in the fuel connection 10 and in the pressure line 14 is pressure relieved for safety reasons and so that in the event of a possible leak in one of the fuel valves 16, no fuel can get into the combustion chamber of the engine. When the engine is shut off, the pressure of the fuel in the fuel connection 10 and in the pressure line 14 is usually close to atmospheric pressure or slightly above it. When the engine is shut off, depending on the surrounding temperature of the fuel connection 10 and the pressure line 14 and depending on the fuel used, a vapor bubble of greater or lesser size is possibly present in the fuel connection 10 or in the pressure line 14. The vapor bubble can be comprised of a number of individual bubbles.

In a startup process, but particularly when the control device 20 should, as a result of a program that has been input, be under the impression from sensor signals that a vapor bubble could have formed, the electric motor 8 that drives the first fuel pump 6 is started at the beginning of the startup process. The electric motor 8 is operated in this connection so that it functions with a significantly increased drive speed, by means of which the first fuel pump 6 delivers a flow rate that is correspondingly increased in comparison to the normal operating state that prevails at a normal fuel temperature. Since an increased quantity of fuel is supplied into the fuel connection 10 during the startup process, but only a little fuel is consumed by the fuel valves 16, an excessive quantity of fuel flows through the throttle valve 30*d* into the fuel line 22 in comparison to the normal operating state. Since the throttle valve 30*d* has a relatively small free cross section and is therefore embodied so that the through flow resistance increases superproportionally with an increase in fuel flowing through, the dynamic pressure produced by the throttle valve 30*d* is increased significantly during startup.

This dynamic pressure of the throttle valve 30*d* that is produced in this manner is added to the pressure that is maintained by the pressure control valve 26. As a result, the value of the delivery pressure in the fuel connection 10 during the startup process increases considerably above the normal value of the delivery pressure so that during the startup process, the vapor bubble that is possibly present in the fuel connection 10 and/or in the pressure line 14 is very rapidly compressed. By means of the opening device 40, the fuel delivered by the first fuel pump 6 can also travel into the pressure line 14. As a result, the high delivery pressure that prevails in the fuel connection 10 also spreads into the pressure line 14. The vapor bubble that is possibly present in the pressure line 14 is compressed by this relatively high delivery pressure, even before the second fuel pump 12 really begins to function.

Since the first fuel pump 6 is operated with a considerably higher delivery capacity during the startup process, the delivery pressure in the fuel connection 10 increases significantly higher than if the fuel pump 6 were to be operated with a normal delivery capacity, and the fuel can travel in a greater quantity and at a higher pressure through the check valve 40*a* into the opening device 40, into the pressure line 14, and to the fuel valves 16.

At the beginning of the startup process, the delivery quantity of the second fuel pump 12 is zero. Then, during the startup process, the delivery quantity of the second fuel pump 12 is very low, which is why if the first fuel pump 6 were to not remove the possible vapor bubble, the compression of the possible vapor bubble would take a very long time, which would delay the startup process significantly. Since the first pump 6 is driven with the electric motor 8, it is possible to begin with the compression of the vapor bubble before the second fuel pump 12 begins to function. The increased delivery capacity of the first fuel pump 6 additionally shortens the startup process significantly. Since the first fuel pump 6 delivers a considerably increased fuel quantity during the startup process, the compression of the vapor bubble occurs very rapidly and the startup process is advantageously very short.

Since the startup process is only short and the first fuel pump 6 is only driven for a short time with overspeed for the startup process, the increased loading of the fuel pump 6 and the electric motor 8 does not on the whole have a noticeable effect in the service life of these components.

During the startup process, the pressure in the fuel connection 10 increases until it reaches the pressure set at the other pressure control valve 28. The other pressure control valve 28 achieves the fact that the delivery pressure in the fuel connection 10 assumes a defined maximal value independent of delivery tolerances of the first fuel pump 6 and independent of throttle tolerances of the throttle valve 30*d*. Even possible speed tolerances of the electric motor 8 while it is operating at a superelevated speed are not noticeable when there is delivery pressure in the fuel connection 10 due to the other pressure control valve 28. The delivery pressure in the fuel connection 10 and in the pressure line 14 has an adjustable maximal value that can be precisely defined.

In the normal operating state, at the normal temperature of the fuel, if the first fuel pump 6 is driven with normal speed and the second fuel pump 12 withdraws a considerable portion of the fuel from the fuel connection 10, and as a result only a small portion of the fuel flows back through the fuel line 22 to the fuel tank 2, then the throttling by means of the throttle valve 30*d* is relatively slight, which leads to the fact that the delivery pressure in the fuel connection 10 during this operating state is lower than during the startup process. The throttling by means of the throttle valve 30*d* plays hardly any role in this connection. In this operating state, essentially the pressure control valve 26 that is set to a low pressure thus determines the level of the delivery pressure in the fuel connection 10.

Since during the operation of the engine at an increasing temperature of the fuel in the fuel connection 10, the danger increases that fuel vapor bubbles form in the fuel connection 10, the danger of vapor bubble formation must be suppressed by means of sufficiently high delivery pressure in the fuel connection 10. Therefore, the proposal is made that with increased fuel temperature, the first fuel pump 6 is operated with an increased speed, by means of which its delivery quantity increases since more fuel flows through the throttle valve 30*d*, which leads to an increased delivery pressure in the fuel connection 10.

Since the danger of the vapor bubble formation decreases as the fuel temperature drops, it is sufficient to provide for an increased delivery pressure only in the event of increased fuel temperature. Since the first fuel pump 6 operates with an increased delivery capacity in the event of increased fuel temperature, but this is not required at average and low temperatures, with the proposed fuel supply system, when there are average and low temperatures, the delivery pressure can be selected as lower than in an embodiment in which no increase in the delivery pressure occurs in the event of higher fuel temperature. That is, since at average and low temperatures, the first fuel pump 6 is only burdened with a decreased delivery pressure, wherein the speed of the first fuel pump 6 can also be lower, the proposed measure results in a considerable extension of the service life of the first fuel pump 6 and on the whole, a lower consumption of electrical drive energy by the first fuel pump 6.

In order to control the delivery capacity of the first fuel pump 6, it is preferably proposed that the sensor 54 be disposed so that it immediately and directly measures the temperature of the fuel in the fuel connection 10. Frequently, however, it is also sufficient if the temperature at another location is taken into account for controlling the delivery capacity of the first fuel pump 6, for example the temperature of the fuel in the pressure line 14 or the temperature of the cooling water of the engine. If in order to save, for example, an additional sensor, the fuel temperature in the fuel connection 10 is not directly sensed, but for example only the temperature of the cooling water, then the existing fuel temperature can in fact be at least approximately deduced from the cooling water temperature.

The valve device 30, which is embodied in the form of the throttle valve 30*d*, has the advantage that the delivery pressure can be increased if need be, particularly during the startup process and/or in the event of high fuel temperature, without a controllable and therefore costly valve being required for this, which significantly simplifies the manufacture costs of the fuel supply system.

With the fuel supply system proposed, in the normal operating state, the pressure control valve 26 essentially determines the delivery pressure in the fuel connection 10 and during the startup process or in the event of high fuel temperature, the other pressure control valve 28 determines the delivery pressure in the fuel connection 10. The other pressure control valve 28 at least assures that the delivery pressure does not exceed a maximal value.

The quantity of fuel flowing from the pressure line 14 that is required by the engine can be determined from the injection times of the fuel valves 16 and also from taking the engine speed into account. So that as little fuel as possible flows unused out of the fuel connection 10, through the fuel line 22, and into the fuel tank 2 during the normal operating state, the proposal is made to control the speed of the electric motor 8 so that the first fuel pump 6 always delivers precisely the amount of fuel that is taken from the fuel line by the fuel valves 16. In order to prevent cavitation on the low pressure side 12*n* of the second fuel pump 12, the proposal is made to control the first fuel pump 6 so that it always delivers slightly more than is consumed by the fuel valves 16.

If the quantity of fuel taken out of the pressure line 14 is to be more precisely determined, then the pressure detected by the pressure sensor 48 can also be taken into account for the calculation of the fuel withdrawn. By determining the injection time of the fuel valves 16 while also taking into account the engine speed and/or alternatively taking into account the pressure in the pressure line 14 detected by the pressure sensor 48, the quantity of fuel to be delivered by the first fuel pump 6 can be controlled quite precisely without additional sensors being required for this purpose. This offers the advantage that during the normal operating state, despite the uncontrollable throttle valve 30*d* in the fuel line 22, the delivery pressure in the fuel connection 10 can be very precisely maintained at a value that can be predetermined.

Figure 2:
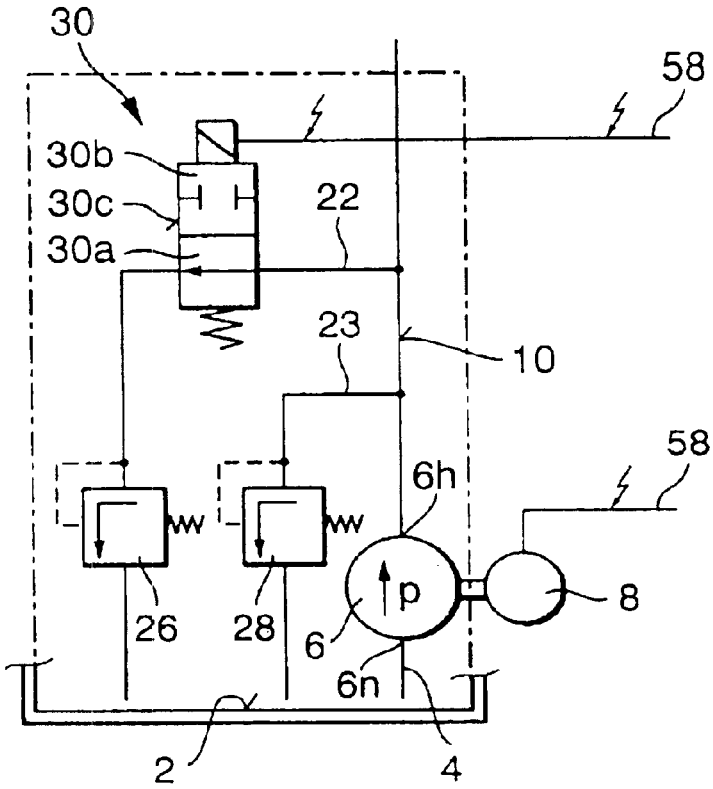

FIG. 2 shows a detail from another exemplary embodiment that has been modified in relation to FIG. 1, in an exemplary form with an altered scale. The parts not shown in FIG. 2 correspond to those shown in the remaining Figs.

In all of the Figs., parts that are the same or function in the same manner are given the same reference numerals. Provided that nothing to the contrary is mentioned or is depicted in the drawings, that which is mentioned and depicted in conjunction with one of the Figs. also applies to the other exemplary embodiments. As long as nothing to the contrary ensues from the explanations, the details of the different exemplary embodiments can be combined with one another.

In the other exemplary embodiment, a detail of which is shown in FIG. 2, the valve device 30 is modified in relation to the one in FIG. 1 in such a way that the fixed throttle valve 30*d* depicted in FIG. 1 is replaced by an on-off valve 30*c*.

The on-off valve 30*c* has a first switched position 30*a* and a second switched position 30*b*. In the first switched position 30*a*, fuel can flow from the fuel connection 10, through the fuel line 22, via the pressure control valve 26, and into the fuel tank 2. If the valve device 30 is disposed in its second switched position 30*b*, then the fuel line 22 is shut off.

In the normal operating state of the engine, i.e. after the end of the startup process of the engine and when the fuel temperature is not too high, the valve device 30 is disposed in its first switched position 30*a*. While the valve device 30 is disposed in the first switched position 30*a*, the delivery pressure of the fuel in the fuel connection 10 is determined by the pressure control valve 26. The pressure control valve 26 assures that in the normal operating state, the delivery pressure of the fuel in the fuel connection 10 is kept as constantly as possible at a normal value, for example at 3 bar, which corresponds to 300 kPa.

During the startup process or in the event of increased fuel temperature, the on-off valve 30*c* of the valve device 30 is switched into its second switched position 30*b* in which the passage for the fuel through the fuel line 22 is closed. When the fuel line 22 is closed, the other pressure control valve 28 determines the level of the delivery pressure in the fuel connection 10.

Also in the exemplary embodiment shown in FIG. 2, increasing the delivery capacity of the first fuel pump 6 by increasing the speed of the electric motor 8 can accelerate the pressure buildup in the fuel connection 10 and in the pressure line 14, and as a result, the starting time can be significantly shortened and the danger of a vapor bubble formation can be eliminated.

Figure 3:
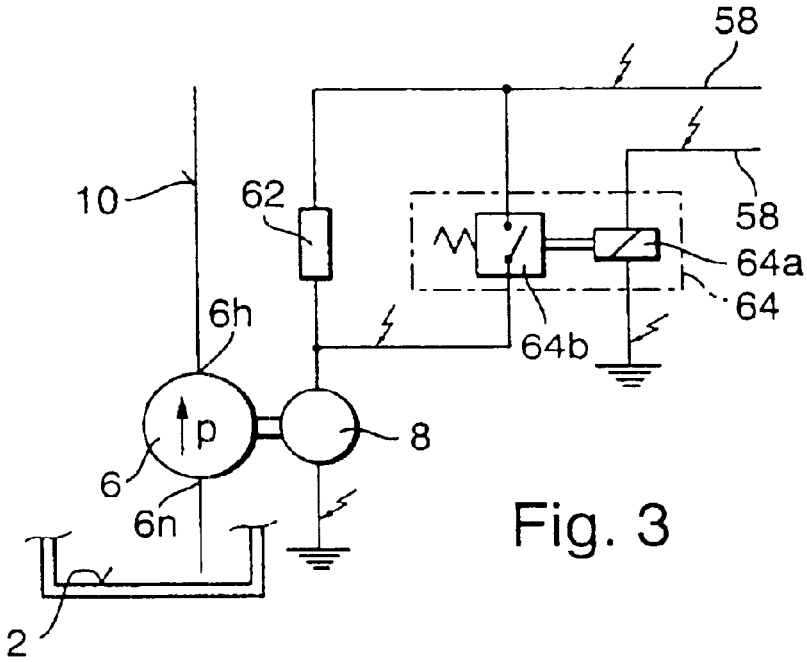
FIG. 3 shows, by way of example, other advantageous details of the fuel supply system according to the invention.

FIG. 3 shows other details of a preferably selected exemplary embodiment.

In conjunction with a preferably selected exemplary embodiment, FIG. 3 shows how the ability to change the drive speed of the electric motor 8 can be realized in a very simple manner without high technical costs.

A series resistor 62 is provided in the electrical line 58 via which the electric motor 8 receives its electrical energy. The series resistor 62 is disposed electrically in series with the electric motor 8. A switching relay 64 is also provided. The switching relay 64 has a switching magnet 64*a* and a switch 64*b*. The switching magnet 64*a* can open and close the switch 64*b*. The switch 64*b* is disposed in the same electrical line as the series resistor 62 and is electrically connected in parallel with the series resistor 62.

The switching relay 64 is preferably embodied so that when the switching magnet 64*a* is supplied with current, the switch 64*b* is closed and when the switching magnet 64*a* is without current, the switch 64*b* is open.

The electromagnet 64*a* is not supplied with power and the switch 64*b* is opened so that the electric motor 8 operates with a normal or low speed during the normal operating state of the engine. The distribution voltage is dimensioned so that together with the series connected series resistor 62, just the voltage that is provided for the normal operating state is present at the electric motor 8 and this voltage is selected so that a sufficient service life of the electric motor 8 is assured.

If necessary, preferably during a startup process of the engine and/or in the event of increased fuel temperature, the switching magnet 64*a* is supplied with current and as a result, the switch 64*b* is closed. This leads to a bypassing of the switch 64*b* and to the fact that an increased voltage is present at the electric motor 8. However, since the startup process is quite short and an increased fuel temperature only occurs intermittently, this does not lead to any noticeable reduction in the service life of the electric motor 8 or the first fuel pump 6.

The series resistor 62 and/or the switching relay 64 can be disposed directly in the vicinity of the electric motor 8 or can be integrated into the control device 20.

The function of the opening device 40 can be integrated directly into the second fuel pump 12 if a pump is used that does not hinder a flow of the fuel from the low pressure side 12*n* to the high pressure side 12*h* or only does so to an insignificant degree. In this instance, the separate opening device 40 can be eliminated (FIG. 1).

Provided that nothing to the contrary is indicated in the above description, in the drawings, or in the claims, the fuel supply system can otherwise be embodied in the same way as is disclosed in the published, non-examined German patent disclosure DE 195 39 885 A1 as well as in the French patent disclosure document FR 27 34 601 A1 and in the Japanese patent disclosure document JP 83 34 076 A2.

The foregoing relates to preferred exemplary embodiments of the invention, it being understood that other variants and embodiments thereof are possible within the spirit and scope of the invention, the latter being defined by the appended claims.

We claim:

1. A fuel supply system for delivering fuel for an internal combustion engine, comprising a fuel tank, a first fuel pump (6) for pumping a variable pumping capacity, a mechanically driven second fuel pump (12), and at least one fuel injection valve (16), wherein the first fuel pump (6) delivers the fuel from the fuel tank into a fuel line connection (10) and the second fuel pump (12) delivers the fuel from the fuel line connection (10) by way of a fuel pressure line (14) to the fuel valve (16), via which the fuel travels at least indirectly into a combustion chamber of the engine, the first fuel pump (6) delivers the fuel into the fuel line connection (10) with a delivery capacity that is changed as a function of an operating condition of the engine, in which two pressure control valves (26, 28), which are hydraulically and functionally parallel and are set to different pressure values, are provided for monitoring a delivery pressure prevailing in the fuel line connection (10).

2. The fuel supply system according to claim 1, in which the first fuel pump (6) is operated at different speeds.

3. The fuel supply system according to claim 1, in which for a startup of the engine, the first fuel pump (6) delivers the fuel into the fuel line connection (10) with an increased delivery capacity.

4. The fuel supply system according to claim 2, in which for a startup of the engine, the first fuel pump (6) delivers the fuel into the fuel line connection (10) with an increased delivery capacity.

5. The fuel supply system according to claim 3, in which for the startup of the engine, the first fuel pump (6) is operated with an overspeed.

6. The fuel supply system according to claim 4, in which for the startup of the engine, the first fuel pump (6) is operated with an overspeed.

7. The fuel supply system according to claim 1, in which the first fuel pump (6) operates as a function of a fuel temperature.

8. The fuel supply system according to claim 2, in which the first fuel pump (6) operates as a function of a fuel temperature.

9. The fuel supply system according to claim 7, in which the first fuel pump (6) operates with greater delivery capacity in the event of higher fuel temperature.

10. The fuel supply system according to claim 1, in which the first fuel pump (6) is driven by an electric motor (8), wherein the drive speed of the electric motor (8) is changed as a function of the operating conditions of the engine.

11. The fuel supply system according to claim 2, in which the first fuel pump (6) is driven by an electric motor (8), wherein the drive speed of the electric motor (8) is changed as a function of the operating conditions of the engine.

12. The fuel supply system according to claim 1, in which the first fuel pump (6) is driven by an electric motor (8), and an electrical series resistor (62) is electrically connected in series with the electric motor (8).

13. The fuel supply system according to claim 2, in which the first fuel pump (6) is driven by an electric motor (8), and an electrical series resistor (62) is electrically connected in series with the electric motor (8).

14. The fuel supply system according to claim 1, in which fuel flowing out of the fuel line connection (10) through the pressure control valves (26, 28) feeds into the fuel tank (2).

15. The fuel supply system according to claim 1, in which the first fuel pump (6) feeds as a function of an injection time of the at least one fuel valve (16).

16. The fuel supply system according to claim 1, in which the first fuel pump (6) feeds fuel under pressure as a function of a speed of the engine.

17. The fuel supply system according to claim 1, in which the first fuel pump (6) feeds fuel under pressure as a function of a pressure in the pressure line (14).

18. The fuel supply system according to claim 1, in which a valve device (30, 30C, 30*d*) is provided, which influences a delivery pressure in the fuel line connection (10) in an operationally dependent manner.

19. The fuel supply system according to claim 18, in which the valve device (30, 30*c*, 30*d*) is provided in a fuel line (22) leading from the fuel line connection (10) into the fuel tank (2) and is disposed hydraulically and functionally in series with a pressure control valve (26).

20. The fuel supply system according to claim 18, in which the valve device (30, 30*d*) has a through flow resistance that depends on the through flow of the fuel passing through the valve device (30, 30*d*).

21. The fuel supply system according to claim 19, in which the valve device (30, 30*d*) has a through flow resistance that depends on the through flow of the fuel passing through the valve device (30, 30*d*).

22. The fuel supply system according to claim 18, in which the valve device (30, 30*c*) is an electrically switchable on-off valve (30*c*).

23. The fuel supply system according to claim 19, in which the valve device (30, 30*c*) is an electrically switchable on-off valve (30*c*).

24. The fuel supply system according to claim 20, in which the valve device (30, 30*c*) is an electrically switchable on-off valve (30*c*).

25. A fuel supply system for delivering fuel for an internal combustion engine, comprising a fuel tank, a first fuel pump (6) for pumping a variable pumping capacity, a mechanically driven second fuel pump (12), and at least one fuel injection valve (16), wherein the first fuel pump (6) delivers the fuel from the fuel tank into a fuel line connection (10) and the second fuel pump (12) delivers the fuel from the fuel line connection (10) by way of a fuel pressure line (14) to the fuel valve (16), via which the fuel travels at least indirectly into a combustion chamber of the engine, the first fuel pump (6) delivers the fuel into the fuel line connection (10) with a delivery capacity that is changed as a function of an operating condition of the engine, in which a valve device (30, 30*c*, 30*d*) is provided, which influences a delivery pressure in the fuel line connection (10) in an operationally dependent manner, and further, in which the valve device (30, 30*c*, 30*d*) is provided in a fuel line (22) leading from the fuel line connection (10) into the fuel tank (2) and is disposed hydraulically and functionally in series with a pressure control valve (26).

* * * * *